US007550175B1

(12) United States Patent
Blankenship et al.

(10) Patent No.: US 7,550,175 B1
(45) Date of Patent: Jun. 23, 2009

(54) METHOD FOR SELECTING AN ASPHALT MIXTURE FOR MAKING AN INTERLAYER AND METHOD OF MAKING AN INTERLAYER

(75) Inventors: Phillip B. Blankenship, Wichita, KS (US); Joseph Drbohlav, III, Wichita, KS (US); Michael L. Hines, Wichita, KS (US)

(73) Assignee: SemMaterials, L.P., Tulsa, OK (US)

( * ) Notice: Subject to any disclaimer, the term of this patent is extended or adjusted under 35 U.S.C. 154(b) by 473 days.

(21) Appl. No.: 09/893,314

(22) Filed: Jun. 27, 2001

(51) Int. Cl.
*E01C 3/00* (2006.01)
*E01C 3/06* (2006.01)

(52) U.S. Cl. ..... 427/138

(58) Field of Classification Search ..... 404/27, 404/31, 32, 33; 427/138, 139
See application file for complete search history.

(56) References Cited

U.S. PATENT DOCUMENTS 3,891,585 A * 6/1975 McDonald ..... 523/307
3,907,582 A * 9/1975 Walter ..... 106/284.01
5,306,750 A * 4/1994 Goodrich et al. ..... 524/59
5,445,473 A 8/1995 Chaverot et al.
5,513,925 A 5/1996 Dempsey et al.
5,795,929 A * 8/1998 Grubba ..... 524/60
5,973,037 A * 10/1999 Fields ..... 524/60
6,074,469 A * 6/2000 Collins et al. ..... 106/273.1
6,089,783 A 7/2000 Goacolou
6,248,396 B1 * 6/2001 Helf ..... 427/138

OTHER PUBLICATIONS

Harvey et al., "Fatigue Performance of Asphalt Concrete Mixes and Its Relationship to Asphalt Concrete Pavement Performance in California: A Report Prepared for California Department of Transportation," Oct. 1995, Asphalt Research Program, CAL/APT Program, Institute of Transportation Studies, University of California at Berkeley.*
Request for Bid for Constructing or Improving, Missouri Highway and Transportation Commission, Jefferson City, Missouri, 1998.
Sand Anti-Fracture (SAF) Mixture Trial Handout, 1998.
Sand Anti-Fracture Layer "SAF" Handout, 1997.

* cited by examiner

*Primary Examiner*—William Phillip Fletcher, III
(74) *Attorney, Agent, or Firm*—Head, Johnson & Kachigian

(57) ABSTRACT

A system for repairing roads is provided. The system includes a highly strain tolerant, substantially impermeable, reflective crack relief interlayer. The interlayer includes a polymer modified asphalt binder mixed with a dense fine aggregate mixture. About 100% of the aggregate should be able to pass through about a 9.5 mm sieve. The interlayer mix is designed using volumetrics and verified using a Flexural Beam Fatigue test and a Hveem Stability test. Preferably, an HMA overlay that is compatible with the interlayer, as well as the demands of local traffic, is placed over the interlayer so that a protected, smooth road surface is provided. The system may delay the first appearance of cracks and the severity of cracks for several years compared with traditional hot mix overlays and extend pavement service life.

22 Claims, 2 Drawing Sheets

METHOD FOR SELECTING AN ASPHALT MIXTURE FOR MAKING AN INTERLAYER AND METHOD OF MAKING AN INTERLAYER

STATEMENT REGARDING FEDERALLY SPONSORED RESEARCH OR DEVELOPMENT

Not Applicable.

CROSS-REFERENCE TO RELATED APPLICATIONS

Not Applicable.

BACKGROUND OF THE INVENTION

The present invention relates to an interlayer placed on cracked roads to repair them. More specifically, this interlayer includes a mixture of aggregate and preferably polymer modified asphalt that is used to delay or stop the occurrence of cracking, control crack severity, reduce overlay thickness, and enhance waterproofing capabilities.

When pavements deteriorate, they may be overlaid with hot mix asphalt (HMA) to repair them. When designing an overlay, the rate of crack propagation through the overlay, the rate of deterioration of the reflective crack, and the amount of water that can infiltrate through the cracks must be considered. One disadvantage with such HMA overlays is that cracks in the old pavement reflect through the new overlay. To relieve this reflective cracking, thicker overlays must be placed. Another disadvantage with such HMA overlays is that they are permeable allowing water to enter the base. A third disadvantage with these overlays is that they typically have a low strain tolerance and a low resistance to reflective cracking.

Asphalt binders which display the ability to undergo creep or stress relaxation at low temperatures in order to minimize the potential for thermal and reflective cracking may be created. The disadvantage with such binders is that they are highly ductile, and thus, roads created with them tend to rut.

Asphalt binders with a high shear modulus that resist rutting at high temperatures may also be created. The disadvantage with such binders is that they tend to be brittle at low temperatures, and thus, roads created with them tend to crack. Typical asphalt binders formulated for pavement applications usually display either high shear modulus at high temperatures or high ductilities at low temperatures but not both.

Other reflective crack control measures that are used to rehabilitate distressed Portland Cement Concrete (PCC) pavements include placing stress-absorbing membrane interlayers (SAMI), placing grids or fabrics as an interlayer before placing HMA, break and seat of PCC, rubblization of PCC, and reconstruction. One disadvantage with these processes is that they can be expensive. Another disadvantage with these processes is that if the road is not reconstructed, it may still have cracking problems.

In order to overcome these disadvantages, an overlay that is able to slow reflective cracking without rutting and protect the pavement structure is needed. Still further, this overlay should be easy to apply and provide a smooth riding surface.

SUMMARY OF THE INVENTION

It is an object of the present invention to provide a substantially impermeable interlayer for distressed pavement so that the distressed pavement is protected from moisture.

It is a further object of the present invention to provide a system for repairing a distressed and cracked road so that existing underlying cracks are delayed from reflecting through the entire pavement including the interlayer and so that raveling and further deterioration of the cracks are prevented.

Another object of the present invention is to provide a method for slowing the deterioration of Portland Cement Concrete (PCC) pavements that are reaching the end of their design life so as to delay the reconstruction of these roadways.

The system of the present invention includes a highly strain tolerant, substantially impermeable (see FIG. 3), hot mix reflective crack relief interlayer. The interlayer includes a polymer modified asphalt binder mixed with a dense fine aggregate mixture. About 100% by weight of the aggregate should be able to pass through about a 9.5 mm sieve. The interlayer mix is designed using a fatigue test and a stability test, preferably a Flexural Beam Fatigue test and a Hveem Stability test (or rut tester) are performed. Preferably, an HMA overlay that is compatible with the interlayer, as well as the demands of local traffic, is placed over the interlayer so that a protected, smooth road surface is provided. The system of the present invention may delay the first appearance of cracks and the severity of cracks for several years compared with traditional hot mix overlays.

Additional objects, advantages, and novel features of the invention will be set forth in the description that follows and in part will become apparent to those skilled in the art upon examination of the following, or may be learned by practice of the invention.

BRIEF DESCRIPTION OF THE DRAWINGS

In the accompanying figures, which form a part of the specification and are to be read in conjunction therewith.

DETAILED DESCRIPTION OF THE PREFERRED EMBODIMENT

Figure 1:
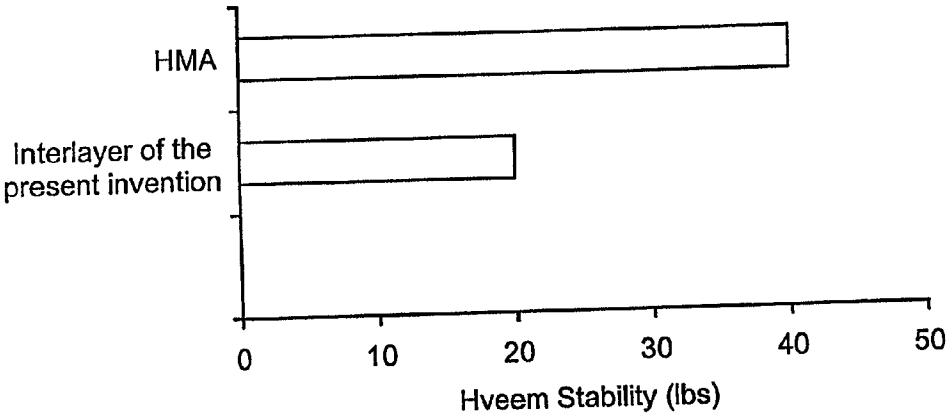
FIG. 1 is a bar graph showing Hveem Stability.

The system of the present invention includes an interlayer and a hot mix asphalt overlay that are placed on distressed surfaces such as PCC pavement. The interlayer delays cracks from reflecting through it and into the overlay. Raveling and further deterioration of those cracks that do appear is also prevented. The reflective crack relief system of the present invention uses hot mix asphalt for both the interlayer and the overlay. It is mixed, transported, placed, and compacted using standard equipment. The present invention includes formulating an interlayer binder, designing the mix for the interlayer, determining what overlay should be applied, and testing the interlayer for performance. Both the formulation of the aggregate mixture design and the asphalt binder properties are approached interactively in the process of the present invention.

The system of the present invention includes a highly strain tolerant, substantially impermeable interlayer. The interlayer is covered with a specified lift of hot mix asphalt (HMA) designed to complement the reflective crack relief interlayer and give the expected crack resistance. Preferably, this HMA overlay is compatible with the interlayer, as well as the demands of local traffic. The interlayer protects the pavement from moisture coming through those cracks that may form in the overlay.

The interlayer is a mixture of binder and aggregate. This binder is most preferably modified with a polymer or polymers to improve its resistance to rutting and cracking. The interlayer is made as follows: The polymer modified asphalt functions as the binder, and its components must be selected based on the climate. Using LTPPBind™ software (Version 2.1) at 98% reliability and a depth of 0 mm, an appropriate binder is selected for the climate. The climate can be classified into one of 3 categories: Northern (Type I), Central (Type II), and Southern (Type III).

The binder includes asphalt or bitumen, one or more polymers, and optionally, a cross-linking agent to effect vulcanization of the polymer in the asphalt. Preferably, the binder is graded according to the AASHTO MP-1 specification, more commonly referred to as the Performance Graded (PG) method.

The Brookfield viscosity of the binder at 135° C. should be less than about 3000 cPs. Preferably, the binder's viscosity is less than about 2500 cPs, and most preferably, it is less than about 2000 cPs.

Second, a minimum shear modulus for the interlayer to resist rutting must be specified. This is done by specifying a minimum high temperature PG grade. This minimum high temperature PG grade depends on the climate or region of the country in which the interlayer will be placed. Selection guidelines for high temperature PG grades are given in Table 1.

There must also be a minimum low temperature PG grade to protect against the potential of single event thermal cracking from shrinking of the interlayer mixture at low temperature. The minimum requirements are also described in Table 1.

Finally, the ability of the interlayer binder to relax stress is quantified by a ductility test on a Rolling Thin Film Oven (RTFO)-aged binder at a temperature of 4° C. with a strain rate of 5 cm/min. Preferably, a force transducer is used during the ductility test to measure force. The binder must maintain at least about one pound force without breaking while meeting the minimum requirements as set forth in Table 1. If the binder breaks before meeting these elongation requirements or cannot meet these elongation requirements, then a different binder should be selected.

Preferably, the best interlayer binder for the climate is selected from Table 1:

ductility requirements as set forth in Table 1. An extender may be used if necessary to meet the desired specifications, examples include the bottoms of re-refined motor oil or other softening agents such as aromatic oils. Typical base asphalts best suited for formulation of the interlayer binder type are provided below as examples of the most preferred embodiment of the present invention.

Type I: AC-2.5 with or without extender

Type II: AC-2.5/AC-5

Type III: AC-10

Those skilled in the art of asphalt binder formulation might select other base asphalt grades.

It is critical that the binder is a compatible system. That is, the polymer(s) and asphalt must be stable against separation in heated storage. A separation test, such as ASTM D5976-96 Sec 6.1, may be performed to determine this. Preferably, there is a maximum of about 6° C. difference in the softening point of the top and bottom sections after 48 hours of storage at 163° C.

If a polymer is utilized to modify the asphalt to optimize interlayer binder performance, it may be any elastomer or plastomer suitable for use in asphalt. Examples of elastomers suitable for use in the present invention are copolymers of styrene and a conjugated diene, with the monomers occurring randomly in the chain backbone or as continuous blocks. Suitable examples of such styrene-conjugated diene elastomers include styrene-butadiene (SB) di-block copolymers, styrene-butadiene-styrene (SBS) block copolymers in both linear and radial forms, and styrene-butadiene rubber (SBR) in both solid and latex forms. Other suitable elastomers based on styrene-conjugated dienes include those containing isoprene monomers in combination with or in place of the butadiene monomers. Also suitable in the current invention are elastomers based on the random copolymerization of isobutylene and isoprene (butyl rubber) and elastomers based on the copolymerization of ethylene, propylene and a suitable diene, more commonly known as EPDM rubber. Additional elastomers suitable for use in the current invention are those arising from the copolymerization of styrene and ethylene

TABLE 1

| LTPP Binder Grade | Binder Type | A | B | C | D | E | F | G | H | I |
|---|---|---|---|---|---|---|---|---|---|---|
| Colder than PG XX-28 | I | 52° C. | 58° C. | 64° C. | −28° C. | −34° C. | −40° C. | 30 cm | 50 cm | 80 cm |
| PG XX-28 to XX-22 | II | 58° C. | 64° C. | 70° C. | −22° C. | −28° C. | −34° C. | 20 cm | 30 cm | 50 cm |
| Warmer than PG XX-22 | III | 64° C. | 70° C. | 76° C. | −16° C. | −22° C. | −18° C. | 10 cm | 20 cm | 35 cm |

Notes:

A Minimum temperature at which the binder complex shear modulus divided by the sine of the phase angle (G*/sin δ) is 2.2 KPa or greater on RTFO residue (AASHTO MP-1);

B Minimum temperature at which the binder G*/sin δ is 2.2 KPa or greater on RTFO residue, more preferably;

C Minimum temperature at which the binder G*/sin δ is 2.2 KPa or greater on RTFO residue, most preferably;

D Maximum temperature at which the binder creep stiffness (S) at 60 seconds is 300 MPa or less on Pressure Aging Vessel (PAV) residue (AASHTO MP-1 using Bending Beam Rheometer (BBR) with test run 10° C. warmer than actual PG grade);

E Maximum temperature at which the binder (S) at 60 seconds is 300 MPa or less on PAV residue, more preferably;

F Maximum temperature at which the binder (S) at 60 seconds is 300 MPa or less on PAV residue, most preferably;

G Minimum 4° C. ductility on RTFO residue; 5 cm/mm strain rate, straight-sided molds (ASTM D113-99);

H Minimum 4° C. ductility on RTFO residue; 5 cm/mm strain rate, straight-sided molds, more preferably; and I Minimum 4° C. ductility on RTFO residue; 5 cm/mm strain rate, straight-sided molds, most preferably.

All measurements in Table 1 are approximate measurements.

An appropriate asphalt base that will meet the low temperature PG requirements is needed, as well as one that is inherently high in ductility. It is modified with polymer as necessary to achieve the minimum high temperature PG and using metallocene catalysts, commonly referred to in the industry as styrene-ethylene interpolymers and elastomers based on the polymerization of chloroprene as a homopolymer or in combination with other suitable monomers, such as isoprene and butadiene. A particularly suitable, commercially available example of the latter is neoprene rubber in either solid or latex form.

Plastomers useful for application in the present invention include those comprising ethylene and propylene monomers, either as homopolymer polyethylene and polypropylene or copolymers containing any combination of ethylene and propylene in the chain backbone. Also included in the list of useful plastomers are the copolymers of ethylene with a second monomer, including ethylene-vinyl acetate (EVA), ethylene, and any suitable acrylic monomer or methacrylic monomer. For example, random copolymers of ethylene and normal butyl acrylate, terpolymers of ethylene, and suitable acrylic monomers, including ethylene, normal butyl acrylate, and glycidyl methacrylate terpolymers may be used. Additional plastomers suitable for use in the current invention include those made by grafting maleic anhydride onto polymer chains comprised of homopolymer polyethylene and copolymers of ethylene and propylene.

Preferably, in hot or warm climates, at least one copolymer of styrene and a conjugated diene containing at least about 30% by mass styrene is used in the binder and at least one copolymer of styrene and a conjugated diene containing less than or equal to about 25% by mass styrene is used in the binder. Most preferably, in a hot or warm climates, these two copolymers are present in about a 1 to 1 ratio. Most preferably, in a cold climate, a copolymer of styrene and a conjugated diene containing less than or equal to about 25% by mass styrene is used to produce the binder.

Optionally, the resulting blend of asphalt and polymer is vulcanized with a cross-linking agent that may contain accelerators. Optionally, the binder may also include extenders. The addition of extenders depends on asphalt properties and climate. Fluxing agents include, but are not limited to, aromatic oils, parafinic oils from refined crude oil, and waste-bottoms from the recycling of lubricant oils.

The present invention describes a novel bituminous material which possesses both high ductility at low temperatures and high shear strength at high temperatures while maintaining a viscosity low enough to allow for effective mixing and compaction. A binder with these properties is especially effective for creating pavement layers designed to withstand, simultaneously, high strains from vertical and horizontal deflection of underlying pavement layers and high shear stresses from traffic. For example, a binder formulated according to the present invention would be effective in a reflective crack retarding hot mix interlayer placed over jointed Portland cement concrete.

The total composition of the binder includes about 80-99% by weight asphalt and asphalt extender, about 1-20% by weight polymer, and about 0-2% by weight cross-linking agent, such as elemental sulfur or a sulfur-donor compound. Preferably, the binder includes about 90-99% by weight asphalt and oil, about 1-10% by weight polymer, and about 0.01-1% by weight elemental sulfur or sulfur-donor compound. Most preferably, the binder includes about 92-96% by weight asphalt and oil, about 4-8.5% by weight polymer, and about 0.04-0.8% by weight elemental sulfur or sulfur-donor compound.

The cross-linking agent or vulcanization agent can be elemental sulfur in the orthorhombic form or any of a class of sulfur-containing compounds known to those skilled in the art as sulfur accelerators. Examples of useful sulfur accelerators include, but are not limited to, those known as thiazole derivatives, thiurams, and dithiocarbamates. Thiazole derivatives that are useful in the sulfur vulcanization process include, but are not limited to, 2-mercaptobenzothiazole and the disulfide, 2,2'-dithiobis(benzothiazole). Metal salts of mercaptobenzothiazole can also be employed, for example, zinc 2-mercaptobenzothiazole may be used. Many di- and polysulfide compounds can be used in the vulcanization process as sulfur accelerators. Examples of this class of accelerators include those based on thiurams, such as dipentamethylenethiuram tetrasulfide, tetrabenzylthiuram disulfide, and tetraethylthiuram disulfide. Dithiocarbamates may also be employed in the present invention as sulfur accelerators. Examples of this class of compounds include nickel dibutyldithiocarbamate, sodium dibenzyldithiocarbamate, and sodium dibutyldithiocarbamate.

The preferred method of producing the binder of the present invention is to first heat the asphalt to a temperature of about 150 to 200° C. and, more preferably, to about 165 to 185° C. While stirring, the polymer is added to the asphalt. It is most preferable to stir the polymer using low shear conditions to avoid any mechanical degradation of the polymer chains. Blending is continued until dissolution of the polymer in the asphalt is visually observed. Normally this takes about 3 to 6 hours, depending upon temperature. Optionally, thereafter, a cross-linking agent is added to the blend, and stirring is continued for a period of about 2 hours to effect complete vulcanization of the blend. The resulting binder should have the minimum properties as set forth in Table 1 for the particular binder type (I, II, or III) selected.

Still further, information is obtained regarding the road surface and traffic level. Following this, the aggregate is selected as shown in Table 2:

TABLE 2

| | Gradations | | |
|---|---|---|---|
| Sieve | Most Preferably % Passing | Preferably % | % Passing |
| ½ inch(12.5 mm) | 100 | 100 | 100 |
| ⅜ inch(9.5 mm) | 100 | 100 | 95-100 |
| No. 4 (4.75 mm) | 91-100 | 85-100 | 80-100 |
| No. 8 (2.36 mm) | 70-78 | 65-82 | 60-85 |
| No. 16 (1.18 mm) | 50-58 | 45-65 | 40-70 |
| No. 30 (600 μm) | 36-44 | 30-50 | 25-55 |
| No. 50 (300 μm) | 20-26 | 17-32 | 15-35 |
| No. 100 (150 μm) | 10-14 | 9-18 | 8-20 |
| No. 200 (75 μm) | 8-10 | 7-12 | 6-14 |

The percentage shown in Table 2 are approximate values. The aggregate is blended to meet the above gradations. It includes crushed and rounded sands. The rounded sand content (also called natural sand) should be about 0-60% by weight. A procedure to measure gradation, such as Sieve Analysis of Fine and Course Aggregates (AASHTO T 27), may be used following the above-listed sieve breakdowns.

The selection of the aggregate is verified using various tests on the aggregate. Aggregate tests may be performed on a stockpile and/or a blend. A Dust to Asphalt Ratio Test (AASHTO MP2) may also be performed. In this test, the amount of No. 200 material and the percentage of asphalt cement is selected so that the Dust/Asphalt Ratio (D/A) is about 0 to 2.0. Preferably, the D/A is about 0.6 to 1.6. Most preferably, the D/A is about 0.6 to 1.2.

Next, the amount of material finer than about 75 μm (No. 200 sieve) in the aggregate may be determined by washing. Preferably, the Standard Method of Test for Materials Finer than 75 μm (No. 200) Sieve in Mineral Aggregates by Washing (AASHTO T 11 or ASTM C 117) is performed.

A field test to show the relative proportions of fine dust or clay-like material in soils or graded aggregates is performed for each aggregate. Preferably the Standard Method of Test for Plastic Fines in Graded Aggregates and Soils by Use of the Sand Equivalent Test (AASHTO T 176) is followed. Preferably, the blend of all aggregates shall meet a minimum of 45%.

If the aggregate does not pass the above-outlined tests, then it must be re-selected. If the aggregate passes the tests, then trial blends of aggregate and binder are made. The mixture is conditioned for short-term and long-term conditioning to simulate the pre-compaction phase of the construction process and the aging that occurs over the service life of the pavement.

The theoretical maximum specific gravity ($G_{mm}$) of the uncompacted mixture is determined. Preferably, the standard method of Test for Theoretical Maximum Specific Gravity and Density of Bituminous Paving Mixtures(AASHTO T 209) is used on 500 g samples at 25° C. The percentage of air voids is determined using $G_{mm}$.

A mix design based on the volumetric properties of the HMA in terms of air voids is created. The loose mixture should be aged for about 2 hours at a compaction temperature according to AASHTO PP2-99 Section 7.1 Volumetric Testing. Preferably, 2 specimens are compacted at 50 gyrations using a 100-mm Superpave gyratory compactor (SGC) mold. Preferably, the Standard Practice for Superpave Volumetric Design for Hot-Mix Asphalt (HMA) (AASHTO PP28-99 Section 8) is performed. The mold and mix should be at about the compacting temperature.

Next, the bulk specific gravity of the compacted specimen is determined. Preferably it is determined by the Standard Method of Test for Bulk Specific Gravity of Compacted Bituminous Mixtures Using Saturated Surface-Dry Specimens (AASHTO T 166). The test should be performed on specimens at 50 gyrations, and then, the volumetrics should be interpolated at 25 gyrations. The volumetric criteria for the specimen is shown in Table 3.

TABLE 3

Volumetric Criteria

| Test | Criteria 50 Gyrations | Preferable Criteria 25 gyrations | Preferable Criteria 50 gyrations |
|---|---|---|---|
| Air Voids (AASHTO PP-28), % | 0.5-2.5 | 1.5-2.5% | 0.5-1.5% |
| VMA (based on $G_{mm}$), % | 16.0 min. | 17 min | 17.0 min |
| Dust/Asphalt Ratio | | 1.2 max (target 1.0 D/A) | |
| VFA | | 90% min | |

The measurements in Table 3 are approximate values.

The interlayer mix blends created are subjected to the Hveem Stability test. The resistance to deformation of the compacted mixture is measured by measuring the lateral pressure developed from applying a vertical load by means of the Hveem stabiliometer. Preferably, the Standard Method of Test for Resistance to Deformation and Cohesion of Bituminous Mixtures by Means of Hveem Apparatus (AASHTO T-246 or ASTM D 1560) is performed. An average value using 3 specimens made at 50 gyrations is calculated. The following criteria shown in Table 4 should be met.

TABLE 4

Hveem Performance Criteria

| Test | Range, Criteria |
|---|---|
| Hveem Stability (AASHTO T-246) @ 140° F., 60° C., 100 mm molds, 50 gyrations | 18.0 min. |

The measurements in Table 4 are approximate values.

If the interlayer mixture specimen does not pass the Hveem Stability test at about 18 minimum, then aggregate or binder must be re-selected. If the blend passes the Hveem test, that blend can be used. FIG. 1 shows the Hveem stability of the interlayer of the present invention compared with a typical hot mix asphalt layer.

Following this, performance testing is conducted on the interlayer mixture. The Hveem Stability (AASHTO T-246) test is performed. The mix is aged for about 4.0 hours at about 135° C. Preferably, the Standard Practice for Mixture Conditioning of Hot-Mix Asphalt (AASHTO PP2-99 Section 7.1) for mechanical property testing is performed.

Fatigue specimens are created from the interlayer mixture. The specimens are compacted into slabs using a linear kneading compactor. The slabs must be kept rigid at all times. The slabs are cut into fatigue beams. Bulk specific gravity tests are performed on the beams. Preferably, the beams have about 3.0% air voids. If the beams have less than about 2.0% or greater than about 4.0% air voids, then the beams should be re-made.

For each climate, fatigue life of the specimens are determined by flexural bending until failure. Preferably, the Standard Test Method for Determining the Fatigue Life of Compacted Hot Mix Asphalt (HMA) Subjected to Repeated Flexural Bending (AASHTO TP8) is performed at 2000 microstrains. The criteria for this test is shown in Table 5.

TABLE 5

Flexural Beam Fatigue Performance Criteria

| Test Parameters | Criteria |
|---|---|
| 2000 Microstrains, 10 Hz, 3.0 ± 1.0% air voids, & 0° C. for ≦ −34 climate Binder Type I 15° C. for ≦ −22 to −34 climate Binder Type II 20° C. for > −22 climate Binder Type III | 100,000 cycles, minimum for an average of 2 samples. |

The measurements in Table 5 are approximate values.

Finally, an optimum mix is determined based on all previous testing. The optimum mix is prepared in 150 mm molds at 50 gyrations.

The formulation is optimized for best performance in retarding reflective cracking while staying within the above-defined requirements. Design information, such as binder type I, II, or III, mixing temperature, compacting temperature, percent asphalt content (% AC) asphalt binder specific gravity, gradation of individual aggregates and blend percentages of aggregates, Gsb, Sand Equivalent, compaction method, volumetrics at 50 gyrations, optimum percentage asphalt selection, Flexural Beam Fatigue, and Hveem Stability at 50 gyrations, is determined.

The interlayer binder is manufactured according to the procedure previously described. If the road is not structurally sound or is severely distressed, it should be patched and repaired before applying the interlayer. Next, the roadway surface should be prepared for receiving the interlayer by optionally sealing cracks and sweeping away loose particles.

General temperatures in which the process takes place to make the asphalt/aggregate interlayer mixture are shown in Table 6.

TABLE 6

| | Binder Type I | Binder Type II | Binder Type III |
|---|---|---|---|
| Liquid Delivery to HMA Plant | 290-310° F. | 310-330° F. | 330-350° F. |
| Mix | 300-320° F. | 320-340° F. | 340-360° F. |
| Laydown | 280-300° F. | 300-320° F. | 320-350° F. |
| Compaction | 270-290° F. | 290-310° F. | 310-330° F. |
| Finish Rolling | 180-200° F. | 180-200° F. | 180-200° F. |
| Traffic return/Overlay | <140° F. | <140° F. | <140° F. |

All of the temperatures shown in Table 6 are approximate temperatures.

The binder is typically shipped at about 290-350° F. depending on the binder type. While the binder is hot, it is mixed with aggregate including sand. The aggregate is heated to about 300-360° F. before being added to the mixture. The mixture includes at least about 7% by weight binder. Preferably, it includes about 7-11% by weight binder, and most preferably, it contains about 7.5-10% by weight binder. The interlayer mixture may then be transported and spread on the roadway using standard hot mix construction equipment. The interlayer is applied very hot. The interlayer is usually placed at about 0.5 to 2.0 inches in thickness. Preferably, it is about 0.75 to 1.25 inches thick. Most preferably, it is about 1.0 inch thick. The interlayer thickness need not be adjusted for traffic because the overlay is of a depth that will protect the interlayer. The density of the in-place interlayer shall be about 97%±2% of the maximum specific gravity.

Figure 3:
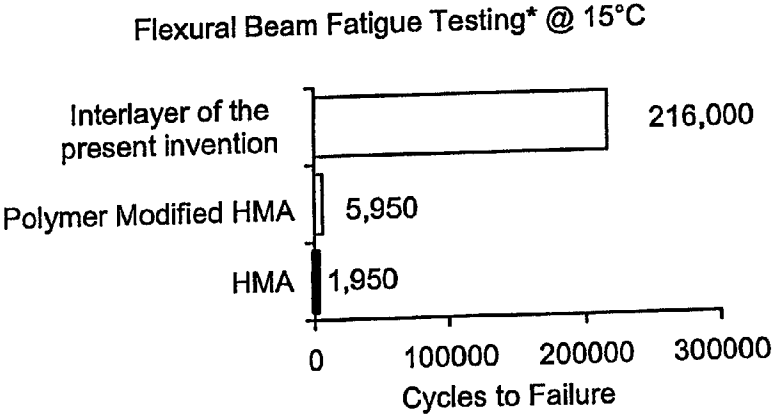
FIG. 3 is a bar graph showing permeability in feet per day per square foot.

The interlayer of the present invention simultaneously provides both high temperature shear strength and low temperature flexibility. In designing the mix of the present invention, both high temperature shear strength and low temperature ductility of the binder are optimized. The interlayer has negligible permeability. (FIG. 3).

While the interlayer of the present invention can withstand traffic for a few days, it is not designed to be a wearing surface. An overlay is needed to provide the wearing surface, and it should be designed to meet the expected traffic demands that will be placed on the pavement. The overlay may be placed on the interlayer after it has had a chance to cool below about 140° F. or after it has cooled for at least about 4 hours. Most preferably, the binder in the overlay includes a styrene butadiene/styrene butadiene styrene (SB/SBS) modified polymer and has about 98 percent reliability for climate, traffic speed and traffic volume. As shown in Table 7, traffic levels indicate the minimum overlay thickness requirements.

TABLE 7

| Overlay Requirements | |
|---|---|
| Traffic (20 yr Equivalent Single Axel Load (ESALs) | Minimum Polymer Overlay Thickness |
| Low (<3 million) | 40 mm |
| Medium (3-10 million) | 60 mm |
| High (>10 million) | 80 mm |

The measurements listed in Table 7 are approximate values.

Figure 2:
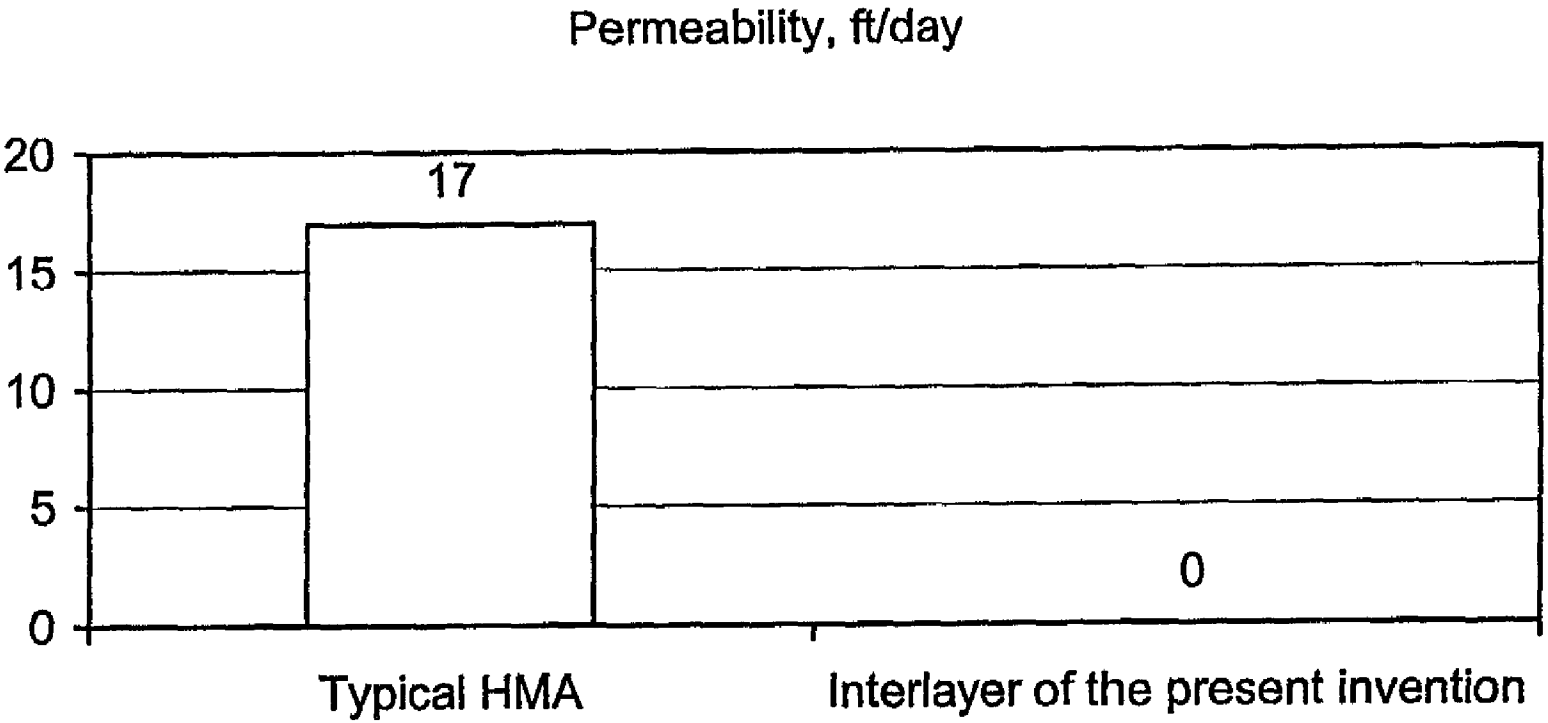
FIG. 2 is a bar graph showing Flexural Beam Fatigue testing at 15° C.

FIG. 2 shows the interlayer mixture's short-term ability to resist rutting. An overlay of at least about 40 mm protects the interlayer from rutting. Cracking will be delayed, but not completely prevented with the system of the present invention. Overlaying longitudinal joints by about 4 to 8 inches improves longitudinal crack resistance.

The system of the present invention delays the first appearance of reflective cracking. It further is effective in delaying total reflective cracking several years. It protects pavement from moisture damage by being substantially impermeable. Still further, it can be recycled. It extends service life of the pavement.

The system of the present invention is designed for, but not limited to, use on structurally sound but cracked Portland Cement Concrete pavements. Jointed pavement should have doweled joints in good condition, and any severely distressed areas should be repaired. The system can also be placed over hot-mix asphalt and composite pavements.

The interlayer is more flexible than typical hot-mix products as illustrated in FIG. 2. FIG. 2 shows test results from the Flexural Beam Fatigue (AASHTO TP-8) test comparing the fatigue resistance of the interlayer and typical conventional and polymer modified dense graded HMA mixtures. At a given applied strain (2000 microstrain at 15° C. and 10 Hz), the interlayer mix withstands many more loading cycles before failure than conventional hot mix asphalt systems. The reflective crack relief system is designed to survive high strain environments and resist cracking longer than conventional HMA. Failure is indicated when the modulus of the interlayer sample drops to 50% of its initial modulus at about 10 cycles.

Example 1

A reflective crack relief interlayer system was produced, tested, and placed according to the present invention. The interlayer binder was produced using 93.85% by mass of a base asphalt grading as an AC-5.3% by mass of a polymer based on styrene and a conjugated diene and containing 21% by mass styrene monomer was used. In addition, 3% by mass of a polymer based on styrene and a conjugated diene containing 30% by mass styrene monomer was used. The polymers were added to the asphalt under low shear conditions at a temperature of 180° C. and stirred for a period of 4 hours. At this time the polymers appeared to be dissolved in the asphalt by visual inspection of the blend. To this blend, under low shear blending conditions and at 180° C., was added 0.15% by mass of elemental sulfur to effect vulcanization of the polymer in the asphalt. The blend was allowed to stir under these conditions for 2 hours at which time a homogeneous polymer modified binder was achieved.

The polymer modified binder had a Brookfield viscosity of 1587 cPs at 135° C. and a complex shear modulus divided by the sine of the phase angle (G*/sin delta) of 2.66 KPa as measured on the dynamic shear rheometer at 70° C. on the RTFO-aged binder.

The RTFO-aged binder had a ductility at 4° C. of 60 cm. The binder subjected to further aging in the Pressure Aging Vessel (PAV) had a creep stiffness of 235 MPa at 60 seconds loading time as measured in the Bending Beam Rheometer (BBR) at −24° C. By reference to table 1 it can be seen that the current binder met the most preferred specifications for a Type II binder. The binder met the requirements for a PG grade of 70-34 and had a ductility greater than 50 cm.

On US 36 in Cameron, Mo., an interlayer was placed on a composite pavement, which was in poor condition. The binder described above was used to make the interlayer. Refer to Table 8 for design details.

TABLE 8

AGGREGATE GRADATIONS - INDIVIDUAL AND BLEND

| | | AGG 1 | AGG 2 | AGG 3 | AGG 4 | | | |
|---|---|---|---|---|---|---|---|---|
| | | Source | | | | | | |
| | | ⅜" | Man. Sand | SCR | Nat. sans | | | |
| | | % in Blend | | | | | | |
| | | 5.0 | 25.0 | 40.0 | 30.0 | 100.0 | External SIEVE | Internal |
| | | | | | | BLEND | Specs | Specs |
| 1½" | 25.00 mm | 100.0 | 100.0 | 100.0 | 100.0 | 100.0 | 100.0 | 100.0 |
| 1" | 19.00 mm | 100.0 | 100.0 | 100.0 | 100.0 | 100.0 | 100.0 | 100.0 |
| ½" | 12.50 mm | 100.0 | 100.0 | 100.0 | 100.0 | 100.0 | 100.0 | 100.0 |
| ⅜" | 9.50 mm | 100.0 | 100.0 | 100.0 | 100.0 | 100.0 | 100.0 | 100.0 |
| #4 | 4.75 mm | 51.8 | 100.0 | 100.0 | 100.0 | 97.6 | 90.0-100.0 | 90.0-100.0 |
| #8 | 2.36 mm | 6.4 | 66.2 | 74.0 | 100.0 | 76.5 | 70.0-80.0 | 70.0-80.0 |
| #16 | 1.18 mm | 4.4 | 33.4 | 46.0 | 98.7 | 56.6 | 50.0-65.0 | 50.0-65.0 |
| #30 | 0.600 mm | 4.0 | 16.5 | 32.0 | 92.3 | 44.8 | 30.0-50.0 | 30.0-50.0 |
| #50 | 0.300 mm | 3.6 | 8.0 | 23.0 | 53.8 | 27.5 | 18.0-30.0 | 18.0-30.0 |
| #100 | 0.150 mm | 3.2 | 5.0 | 18.0 | 7.3 | 10.8 | 8.0-18.0 | 8.0-18.0 |
| #200 | 0.075 mm | 2.8 | 3.6 | 16.0 | 0.9 | 7.7 | 7.0-12.0 | 7.5-9.5 |
| | Aggregate Gsb | 2.545 | 2.576 | 2.537 | 2.607 | 2.568 | | |
| | Fine Aggregate Angularity | | | | | 42.0 | | |
| | Sand Equivalency | | 70.0 | 36.0 | 94.0 | | | |
| | Methylene Blue | | 6.5 | 4.5 | 2.0 | | | |
| | Water Absorption | 1.47 | 1.85 | 2.33 | 0.42 | | | |

COMPACTION RESULTS
Mixing Temperature: 340 F.
Compaction Temperature: 290 F.
Compaction Pine Gyratory n Method: 100 mm mold
Number of Gyrations: 50

| % ASPHALT | % AIR | GSB | | GSE | | | DUST/ |
|---|---|---|---|---|---|---|---|
| BINDER | VOIDS | % VMA | % VFA | % VMA | % VFA | # GYRO | ASPHALT |
| 8.0% | 1.8 | 18.5 | 90.3 | 19.8 | 91.0 | 50 | 1.1 |
| 8.5% | 0.9 | 18.8 | 95.2 | 20.1 | 95.5 | 50 | 1.0 |
| 9.0% | 0.2 | 19.2 | 98.9 | 20.5 | 98.9 | 50 | 1.0 |
| 9.5% | −0.2 | 19.9 | 101.1 | 21.2 | 101.0 | 50 | 0.9 |
| 8.0% | 3.6 | 20.0 | 81.9 | 21.3 | 83.0 | 25 | 1.1 |
| 8.5% | 2.4 | 20.0 | 87.8 | 21.3 | 88.6 | 25 | 1.0 |
| 9.0% | 1.0 | 19.9 | 94.8 | 21.2 | 95.1 | 25 | 1.0 |
| 9.5% | 0.6 | 20.5 | 97.0 | 21.8 | 97.2 | 25 | 0.9 |

| | | | % Air | Gsb | | Gse | | Hveem | 4 Point Beam |
|---|---|---|---|---|---|---|---|---|---|
| Pb* | $G_{mb}$ | $G_{mm}$ | Voids | % VMA | % VFA | % VMA | % VFA | Stability | Fatigue |
| 8.5 | 2.314 50 gyrations | 2.335 | 0.9 | 17.5 | 94.9 | 20.1 | 95.5 | 27.9 | 1000 micro strain, 1.0 × 108 cycles |
| 8.5 | 2.278 25 gyrations | 2.335 | 2.4 | 18.8 | 87.3 | 21.3 | 88.7 | 25.7 | 10 hz, 68° F. [20° C.], 3.0% air voids 2,000,000+ |

$G_{se}$ = 2.650 % 1.2 Absorbed
Asphalt = D/A = 1.0

COMMENTS
QC specimens had 0.9% air voids at 50 gyrations using a Pine compactor.
Beam fatigue air voids = 1.8

Nine months after it was laid, there was no cracking in the section made using an interlayer whereas the control section had two large transverse cracks.

Example 2

A reflective crack relief interlayer system was produced, tested, and placed according to the present invention. On Kansas US 75 in Beto Junction, Kans., an interlayer was place over a PCC pavement in stable condition. The binder described in Example 1 was used to make the interlayer in Example 2. Refer to Table 9 for design details.

TABLE 9

AGGREGATE GRADATIONS - INDIVIDUAL AND BLEND

| | | AGG 1 | AGG 2 | AGG 3 | AGG 4 | | |
|---|---|---|---|---|---|---|---|
| | | % In Blend | | | | | |
| | | 21.0 | 7.0 | 43.0 | 29.0 | 100.0 | |
| | | | | | | SIEVE | |
| | | | | | | Blend | Specs |
| ⅜" | 9.50 mm | 100.0 | 100.0 | 100.0 | 100.0 | 100.0 | 100.0 |
| #4 | 4.75 mm | 99.5 | 99.8 | 84.0 | 99.9 | 93.0 | 80-100 |
| #8 | 2.36 mm | 81.4 | 62.6 | 58.0 | 98.4 | 74.9 | 60-85 |
| #16 | 1.18 mm | 50.4 | 34.2 | 42.0 | 92.3 | 57.9 | 40-70 |
| #30 | 0.600 mm | 27.7 | 17.5 | 32.0 | 63.5 | 39.2 | 25-55 |
| #50 | 0.300 mm | 14.2 | 10.9 | 25.0 | 10.8 | 17.7 | 15-35 |
| #100 | 0.150 mm | 5.9 | 8.7 | 21.0 | 0.3 | 10.9 | 6-71 |
| #200 | 0.075 mm | 2.3 | 7.9 | 18.0 | 0.1 | 8.8 | 6-14 |
| Aggregate Gsb | | 2.566 | 2.497 | 2.543 | 2.600 | 2.561 | |
| Fine Aggregate Angularity | | | | | | 42.0 | |
| Sand Equivalency | | 97.0 | 80.0 | 42.0 | 100.0 | 61.8 | |
| Meth. Blue | | 1.8 | 6.5 | 3.0 | | 2.8 | |
| F & E | | | | 12.0 | | 12.0 | |
| Water Absorption | | 2.97 | 2.84 | 3.20 | 0.18 | 0.54 | |

Example 3

A reflective crack relief interlayer system was produced, tested, and placed according to the present invention. The interlayer binder was produced using 65.7% by mass of a base asphalt grading as an AC-30. To this was added 28.15% by mass of an asphalt flux to soften the AC-30, resulting in a final AC blend with a grading approximately equal to an AC-10. 3% by mass of a polymer based on styrene and a conjugated diene and containing 15% by mass styrene monomer was used. An additional 3% by mass of a polymer based on styrene and a conjugated diene and containing 30% by mass total styrene was also used. The polymers were added to the asphalt under low shear conditions at a temperature of 180° C. and stirred for a period of 5 hours. At this time the polymers appeared to be dissolved in the asphalt by visual inspection of the blend. To this blend, under low shear blending conditions and at 180° C., was added 0.15% by mass of elemental sulfur to effect vulcanization of the polymer in the asphalt. The blend was allowed to stir under these conditions for 2-hours at which time a homogeneous polymer modified binder was achieved.

The polymer modified binder had a Brookfield viscosity of 2865 cPs at 135° C. and a complex shear modulus divided by the sine of the phase angle (G*/sin δ) of 2.51 KPa as measured on the dynamic shear rheometer at 76° C. on the RTFO-aged binder. The RTFO-aged binder had a ductility at 4° C. of 50 cm. The binder subjected to further aging in the Pressure Aging Vessel (PAV) had a creep stiffness of 121 MPa at 60 seconds loading time as measured in the Bending Beam Rheometer (BBR) at −18° C. By reference to table 1 it can be seen that the current binder met the most preferred specifications for a Type III binder. The binder met the requirements for a PG grade of 76-28 and had a 4° C. RTFO ductility greater than 35 cm. On SH 34 in Monroe, La., an interlayer was placed over a composite pavement in stabile condition. The binder described above was used to make the interlayer. Refer to Table 10 for design details.

TABLE 10

AGGREGATE GRADATIONS - INDIVIDUAL AND BLEND
$G_b$ = 1.025

| | | AGG 1 | AGG 2 | AGG 3 | | |
|---|---|---|---|---|---|---|
| | | Type | | | | |
| | | Nat. sand | Limestone | Limestone | | |
| | | % in Blend | | | | |
| | | 32.5 | 32.0 | 35.5 | 100.0 | |
| | | | | | SIEVE | |
| | | | | | BLEND | Specs |
| 1" | 25.0 mm | 100.0 | 100.0 | 100.0 | 100.0 | 100 |
| ¾" | 19.0 mm | 100.0 | 100.0 | 100.0 | 100.0 | 100 |
| ½" | 12.5 mm | 100.0 | 100.0 | 100.0 | 100.0 | 100 |
| ⅜" | 9.5 mm | 100.0 | 100.0 | 100.0 | 100.0 | 100 |
| #4 | 4.75 mm | 98.8 | 97.1 | 69.2 | 87.7 | 91-100 |
| #8 | 2.36 mm | 96.4 | 76.4 | 27.7 | 65.6 | 70-78 |
| #16 | 1.18 mm | 91.9 | 56.6 | 14.6 | 53.2 | 50-58 |
| #30 | 0.600 mm | 72.0 | 41.6 | 10.2 | 40.3 | 36-44 |
| #50 | 0.300 mm | 26.1 | 31.4 | 7.4 | 21.2 | 20-26 |
| #100 | 0.150 mm | 13.6 | 24.6 | 7.0 | 14.8 | 10-14 |
| #200 | 0.075 mm | 1.1 | 17.7 | 6.5 | 8.3 | 8-10 |
| Aggregate Gsb | | 2.659 | 2.647 | 2.671 | 2.659 | |
| Fine Aggregate Angularity | | | | | 43.4 | |
| Sand Equivalency | | 83.0 | 57.3 | 79.0 | 70.4 | 45 min |
| Methylene Blue | | 8.0 | 1.0 | 1.3 | | |
| F & E | | N/A | N/A | N/A | | |
| Water Absorption | | 0.24 | 0.11 | 0.26 | | |

MIXTURE RESULTS
Mixing Temperature: 330-350 F.
Compaction Temperature: 310-310 F.
Compaction Pine Method: 100 mm mold
Gyratory, Nmax (Max. Gyrations): 50

| Gse = 2.682 | | | 50 Gyrations | | |
|---|---|---|---|---|---|
| ASPHALT | | | Air | Using Gsb | |
| BINDER, % | Gmm | Gmb | Voids, % | VMA, % | VFA, % |
| 8.0 | 2.375 | 2.369 | 0.3 | 18.0 | 98.3 |
| 7.5 | 2.392 | 2.374 | 0.8 | 17.4 | 95.4 |
| 7.0 | 2.409 | 2.385 | 1.0 | 16.6 | 94.0 |
| 6.5 | 2.427 | 2.390 | 1.5 | 16.0 | 90.6 |
| Spec | 7.5-10% | | 0.5-1.5 | 17.0 min | 90 min |

| Gse = | | 25 Gyrations | | |
|---|---|---|---|---|
| | Air | Using Gsb | | Dust/ |
| Gmb | Voids, % | VMA, % | VFA, % | Asphalt |
| 2.356 | 0.8 | 18.5 | 95.7 | 1.1 |
| 2.365 | 1.1 | 17.7 | 93.8 | 1.2 |

TABLE 10-continued

| | | | | |
|---|---|---|---|---|
| 2.370 | 1.6 | 17.1 | 90.6 | 1.2 |
| 2.362 | 2.7 | 17.0 | 84.1 | 1.3 |
| | 1.5-2.5 | 17.0 min | | 1.2 max |

| Design | | 50 Gyrations | | | |
|---|---|---|---|---|---|
| JMF | | | % Air | Using Gsb | |
| Pb | $G_{mm}$ | $G_{mb}$ | Voids | % VMA | % VFA |
| 7.0 | 2.407 | 2.380 | 1.1 | 16.8 | 93.5 |
| | Hveem Stability (T-246) @ 60° C. | | | | 23.7 |
| Spec | | 18.0 min | | | |
| D/A = 1.2 | 1.2 max | | | | |

| 25 Gyrations | | | | Beam Fatigue (TP-8), Nf |
|---|---|---|---|---|
| | % Air | Using Gsb | | 2000 microstrains |
| Gmb | Voids | % VMA | % VFA | 20 C. |
| 2.363 | 1.8 | 17.4 | 89.7 | 159,292 |
| | | | 22.8 | |
| | | 18.0 min | | 100,000 min |
| | | Absorbed AC 0.3 (Pba), % = | | |

Comments: QC specimen had 1.7% air voids at 50 gyrations using a Troxler compactor.

From the foregoing, it will be seen that this invention is one well adapted to attain all the ends and objects herein above set forth together with other advantages which are obvious and inherent to the system. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth is to be interpreted as illustrative and not in a limiting sense.

We claim:

1. A method of selecting an asphalt mixture for making an interlayer for a roadway, comprising:

providing at least one asphalt mixture comprised of a polymer-modified binder and mineral aggregate wherein the mineral aggregate is present in the at least one asphalt mixture in an amount greater than about 89% and less than about 93% by weight of the at least one asphalt mixture, the polymer-modified binder mixed under low shear blending conditions;

performing a stability test on said at least one asphalt mixture;

performing a fatigue test on said at least on asphalt mixture; and selecting an asphalt mixture for said interlayer after performing said stability and fatigue tests based on stability and fatigue performance of said at least one asphalt mixture.

2. The method of claim 1, wherein said stability test is a Hveem stability test and wherein said selected asphalt mixture has a Hveem Stability at 60° C. and 50 gyrations of at least about 18.

3. The method of claim 1, wherein said fatigue test is a Flexural Beam Fatigue Test and said selected asphalt mixture has a Flexural Beam Fatigue of at least about 100,000 cycles at 2000 microstrains, 10 Hz, about 204% air voids, and at a temperature of about 0 to 30° C.

4. The method of claim 1, further comprising:

adding a cross-linking agent to said binder before performing said stability and fatigue tests on said at least one asphalt mixture.

5. The method of claim 1, further comprising:

prior to said providing step, determining the shear modulus, strain tolerance, and the bending creep stiffness of at least one polymer-modified binder; and selecting said binder for making said at least one asphalt mixture after performing and based on said shear modulus, strain tolerance and bending creep stiffness measurement.

6. The method of claim 1, further comprising:

prior to said providing step, determining the rotational viscosity of at least one polymer-modified binder; and selecting said binder for making said at least one asphalt mixture after performing and based on said rotational viscosity measurement.

7. The method of claim 1, further comprising:

performing volumetric testing on said at least one asphalt mixture; and selecting said asphalt mixture for said interlayer after performing said volumetric testing and based on volumetric performance of said at least one asphalt mixture.

8. A method of reconstructing a roadway, said method comprising:

providing at least one asphalt mixture comprised of a polymer binder and mineral aggregate wherein the mineral aggregate is present in the at least one asphalt mixture in an amount greater than about 89% and less than about 93% by weight of the at least one asphalt mixture, the polymer-modified binder mixed under low shear blending conditions;

performing a stability test on said at least one asphalt mixture;

performing a fatigue test on said at least one asphalt mixture;

selecting an asphalt mixture for an interlayer after performing said stability and fatigue tests based on stability and fatigue performance of said at least one asphalt mixture;

applying said selected asphalt mixture as an interlayer to said roadway;

determining a desired thickness of an overlay to be applied to said interlayer based on traffic levels; and applying said overlay to said interlayer in said desired thickness.

9. The method of claim 8, wherein said interlayer is applied at a temperature above about 140° F. and is cooled to below about 140° F. before applying said overlay.

10. The method of claim 8, wherein said roadway is comprised of Portland Concrete Cement.

11. The method of claim 8, further comprising:

sweeping said roadway; and sealing cracks in said roadway before applying said interlayer.

12. The method of claim 8, wherein said overlay is at least about 1 inch thick.

13. The method of claim 8, further comprising:

allowing traffic to drive on said interlayer before applying said overlay.

14. The method of claim 8, wherein said overlay is comprised of hot mix asphalt.

15. The method of claim 14, wherein said overlay is further comprised of a SB/SBS polymer modified asphalt binder.

16. The method of claim 8, further comprising:

performing volumetric testing on said at least one asphalt mixture; and selecting said asphalt mixture for said interlayer after performing said volumetric testing and based on volumetric performance of said at least one asphalt mixture.

17. The method of claim 13, wherein said interlayer is cooled to below about 140° F. before releasing said interlayer to traffic.

18. A method of making an interlayer for a roadway, comprising:

forming an asphalt mixture comprised of a polymer-modified asphalt binder and mineral aggregate wherein the mineral aggregate is present in the asphalt mixture in an amount greater than about 89% and less than about 93% by weight of the at least one asphalt mixture, the polymer-modified binder mixed under low shear blending conditions, said asphalt mixture having a Hveem Stability at 60° C. and 50 gyrations of at least about 18 and a Flexural Beam Fatigue of at least about 100,000 cycles at 2000 microstrains, 10 Hz, about 2-4% air voids, and at a temperature of about 0 to 30° C.; and forming an interlayer for a roadway from said asphalt mixture.

19. The method of claim 18, wherein said polymer-modified asphalt binder has a ductility of at least about 10 cm, at 4° C. on RTFO residue at 5 cm/min strain rate, when using straight-sided molds.

20. A method of selecting an asphalt mixture for making an interlayer for a roadway, comprising:

performing a ductility test on at least one polymer-modified binder;

selecting a binder for making an asphalt mixture after performing said ductility test and based on said ductility test;

providing at least one asphalt mixture comprised of said selected binder and mineral aggregate wherein the mineral aggregate is present in the at least one asphalt mixture in an amount greater than about 89% and less than about 93% by weight of the at least one asphalt mixture, the polymer-modified binder mixed under low shear blending conditions;

performing a stability test on said at least one asphalt mixture;

performing a fatigue test on said at least one asphalt mixture; and selecting an asphalt mixture for said interlayer after performing said stability and fatigue tests based on stability and fatigue performance of said at least one asphalt mixture.

21. The method of claim 20, wherein said selected binder has a ductility of at least about 10 cm, at 4° C. on RTFO residue at 5 cm/min strain rate, when using straight-sided molds.

22. The method of claim 21, wherein said selected asphalt mixture has a Hveem Stability at 60° C. and 50 gyrations of at least about 18 and a Flexural Beam Fatigue of at least about 100,000 cycles at 2000 microstrains, 10 Hz, about 2-4% air voids, and at a temperature of about 0 to 30° C.

* * * * *

UNITED STATES PATENT AND TRADEMARK OFFICE

CERTIFICATE OF CORRECTION

PATENT NO. : 7,550,175 B1
APPLICATION NO. : 09/893314
DATED : June 23, 2009
INVENTOR(S) : Phillip Blankenship et al.

It is certified that error appears in the above-identified patent and that said Letters Patent is hereby corrected as shown below:

Column 16, line 1, change "204%" to --2-4%--

Signed and Sealed this

Eleventh Day of May, 2010

David J. Kappos

David J. Kappos
*Director of the United States Patent and Trademark Office*